US005184187A

United States Patent [19]

Haneda et al.

[11] Patent Number: 5,184,187

[45] Date of Patent: Feb. 2, 1993

[54] COLOR IMAGE FORMING APPARATUS

[75] Inventors: Satoshi Haneda; Shizuo Morita; Masakazu Fukuchi; Shunji Matsuo, all of Hachioji, Japan

[73] Assignee: Konica Corporation, Tokyo, Japan

[21] Appl. No.: 737,177

[22] Filed: Jul. 29, 1991

[30] Foreign Application Priority Data

Aug. 7, 1990 [JP] Japan ..... 2-209050

[51] Int. Cl.[5] ..... G03G 15/01

[52] U.S. Cl. ..... 355/326; 118/657; 355/251

[58] Field of Search ..... 355/212, 326, 327, 298, 355/245, 251, 246; 118/657, 645

[56] References Cited

U.S. PATENT DOCUMENTS 4,949,127 8/1990 Matsuda et al. ..... 355/251

FOREIGN PATENT DOCUMENTS 59-21044 8/1985 Japan ..... 355/212

*Primary Examiner*—A. T. Grimley

*Assistant Examiner*—Shuk Y. Lee

*Attorney, Agent, or Firm*—Jordan B. Bierman

[57] ABSTRACT

A color image forming apparatus in which a guide member, provided between two revolving rollers around which a belt type image carrier is stretched, and on which the belt is slidably conveyed, has a large convex curvature in the direction of belt conveyance, so as to reduce friction between the belt and the guide member. A plurality of developing devices are provided to face the belt type image carrier and include magnetic rolls in which a magnetic pole facing the belt type image carrier most adjacently and one of magnetic poles next to the magnetic pole are disposed at a specific angle. The following formula is satisfied:

$$L/R < \theta$$

where R is the radius of curvature of the guide member, L is the maximum length of the belt type image carrier along the circumferencial surface of the belt type image carrier facing the plurality of developing devices and $\theta$ represents the specific angle.

4 Claims, 4 Drawing Sheets

COLOR IMAGE FORMING APPARATUS

BACKGROUND OF THE INVENTION

The present invention relates to a color image forming apparatus for obtaining images electrophotographicly that a toner image is formed on a belt-like image carrier and is transferred onto a transfer material.

There have been many prior disclosures about electrophotographicly reproducing color images. In Japanese Patent Laid-Open 61-100770, for example, a photoreceptor drum has a latent image formed thereon and is developed corresponding to the number of separated colors of an original image. The image is transferred to a transfer drum every time it is developed to form a multi-color image on the transfer drum. After this, it is transferred onto a recording paper to obtain a color copy. However, this apparatus has a disadvantage that it is needed to have a transfer drum is necessary, which is large enough that a whole page of image can be transferred on the surface thereof. The apparatus is unavoidably large and complicated in construction.

As another example, in the apparatus disclosed in Japanese Patent Laid-Open 61-149972, a photoreceptor drum has a latent image formed thereon and is developed corresponding to the number of separated colors of an original image. The image is transferred to a transfer material every time a color is developed to reproduce a multi-color copy. However, the apparatus described above has the disadvantage that it is hard to accurately register a plurality of color images.

As another example of conventional apparatus, color toner images are registered on a photoreceptor drum by repeatedly forming latent images corresponding to the number of separated colors of an original image on the photoreceptor drum and developing them with color toners. The registered image is then transferred to obtain a color image. This basic process for forming a multi-color image is disclosed in, for example, Japanese Patent Laid-Open 60-75850, 60-76766, 60-95456, 60-95458, and 60-158475.

In multi-color image forming apparatus in which images are registered to obtain a color image, there are provided around the photoreceptor drum a plurality of developing sections containing toners of different colors. The photoreceptor drum is rotated a plurality of times to develop the latent images on the photoreceptor drum.

For the image carrier, a belt-type image carrier having a photoconductive substance coated or mounted on a belt may be used in addition to the photoreceptor drum having the photoconductive substance coated or evaporated on the surface thereof as described above. The belt-like image carrier (hereinafter also referred to as the photoreceptor belt) is desirable for a compact color image forming apparatus to more effectively use space, because its shape is determined by being stretched between revolving rollers including a drive roller. Also, it is desirable in that the photoreceptor belt can be conveyed with a small curvature so that the transfer material can be separated by making use of the curvature of a revolving roller of small diameter. This ensures the transfer material is surely separated.

In color image forming apparatus using the photoreceptor belt, there are provided around the photoreceptor belt; charging means, image exposing means, and developing means comprising a plurality of developing sections. These image forming means face the revolving photoreceptor belt at predetermined distances.

As the image forming means face the photoreceptor belt with certain gaps, backup rollers have been used. However, this method has the disadvantage that it is necessary to arrange a plurality of backup rollers corresponding to the number of the image forming means. If the number of rollers is too much, it is hard to keep parallelism. Further, there is another apparatus disclosed in Japanese Patent Laid-Open 57-34576 in which the image forming means face the photoreceptor belt on a guide member. However, it is hard to keep precise gaps in such an apparatus.

SUMMARY OF THE INVENTION

An object of the present invention is to provide a color image forming apparatus containing a photoreceptor belt, in which image forming means are accurately positioned at predetermined gaps from the photoreceptor belt to reproduce quality images. More particularly, the object of the present invention is to provide a color image forming apparatus in which a plurality of common developing means are provided in a series with each other, thereby reducing the cost of manufacture.

The color image forming apparatus of the present invention comprises two revolving rollers, a guide member having a curvature provided between the two revolving rollers, a belt-like image carrier stretched between the two revolving rollers so as to slide on the curvature of the guide member, and a plurality of developing means provided to face the belt-like image carrier, the plurality of developing means having magnetic rolls of N and S poles alternately arranged so that a magnetic pole facing the belt-like image carrier with a narrowest gap and one of its neighboring magnetic poles are disposed to form a particular angle $\theta$. The angle $\theta$ is $$L/R < \theta \text{radian}$$

where R is radius of curvature of the guide member and L is maximum length along a circumferential surface of the belt-like image carrier facing the developing means.

BRIEF DESCRIPTION OF THE DRAWINGS

Other objects and advantages of the present invention will become apparent hereinafter and in the drawings in which.

DETAILED DESCRIPTION OF THE PREFERRED EMBODIMENT

The color image forming apparatus of the present invention is illustrated in further detail by reference to the accompanying drawings FIGS. 1 through 4.

Figure 1:
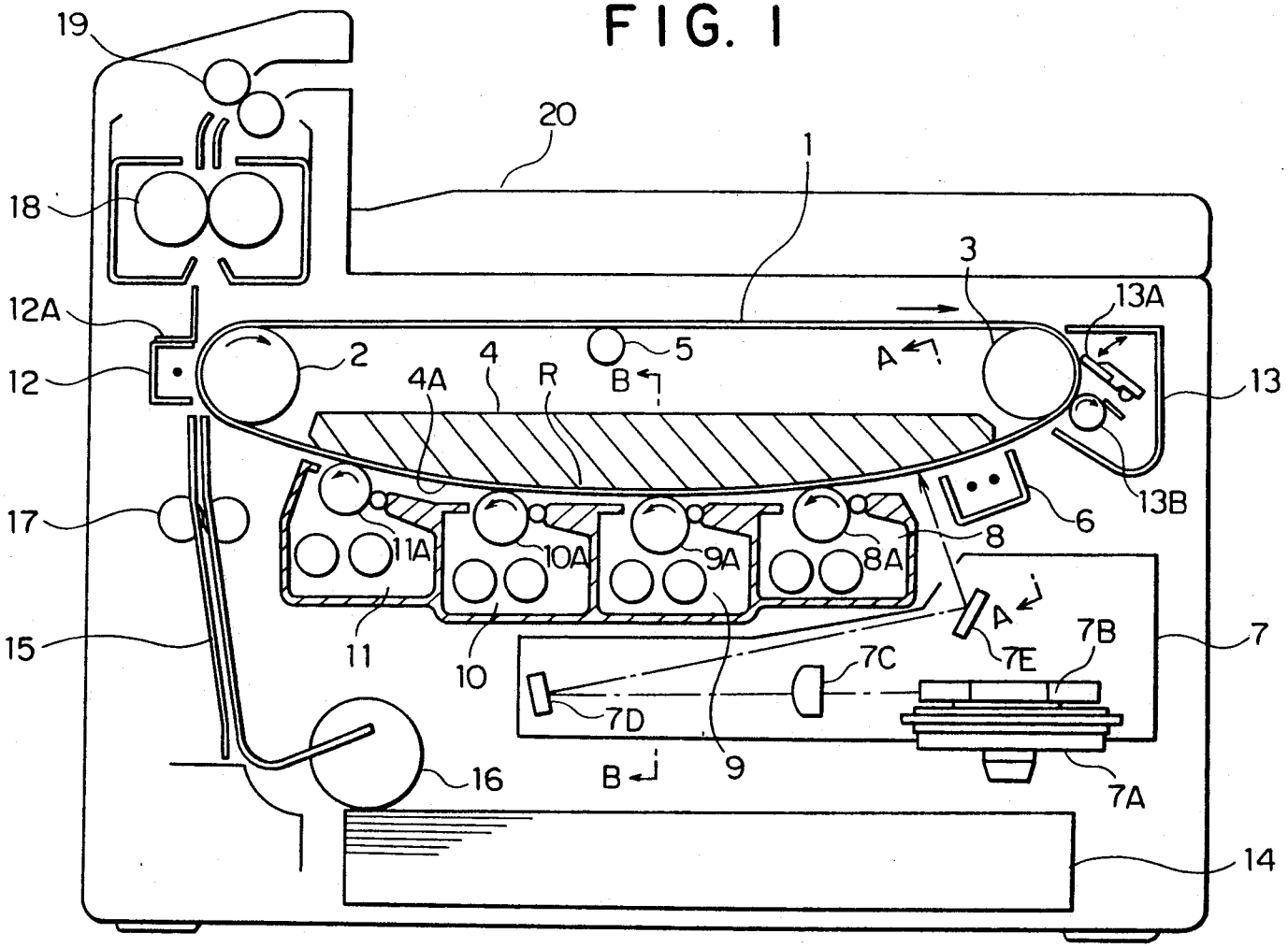
FIG. 1 is a cross sectional view of a color image forming apparatus according to the present invention.

In FIG. 1 is shown a flexible photoreceptor belt 1 which is provided between revolving rollers 2 and 3, and is driven clockwise by the revolving roller 2.

A guide member 4 is mounted to the apparatus body so as to contact an inside of the photoreceptor belt 1.

The photoreceptor belt 1 kept taut by a tension roller 5 so that the belt slides on the guide member 4.

Thus, the photoreceptor on the outside of the photoreceptor belt 1 can be always kept in a certain relationship with respect to the guide member 4. This allows stable image forming.

There are provided image forming means, including a scorotron charger 6 for charging, a laser writing system unit 7 for image exposure, and developing devices 8 through 11 comprising a plurality of developing means containing developer of particular colors, facing the outside of the photoreceptor belt 1.

The laser writing system unit 7 can use an optical system having a light emitting source and a convergent light transmission arrangement integrated together in place of the optical system shown in the figure.

The developing devices 8 through 11 contain the developer of, for example, yellow, magenta, cyan, and black, respectively, for each of which developing sleeves 8A through 11 A are arranged to provide predetermined gaps to develop latent images on the photoreceptor belt 1 in a non-contact developing method. The non-contact developing method, unlike the contact developing method, is advantageous in that photoreceptor belt 1 is not impeded from moving.

There are arranged around the outside of the photoreceptor belt 1 a transfer means 12, a discharge bar 12A, and a cleaning means 13. A blade 13A and a toner feed roller 13B of the cleaning means 13 are kept separated from the outside of the photoreceptor belt 1, but are brought into contact with the outside during cleaning after image transfer as shown in the figure.

The following describes processes of color image forming in the color image forming apparatus of the present invention.

Figure 2:
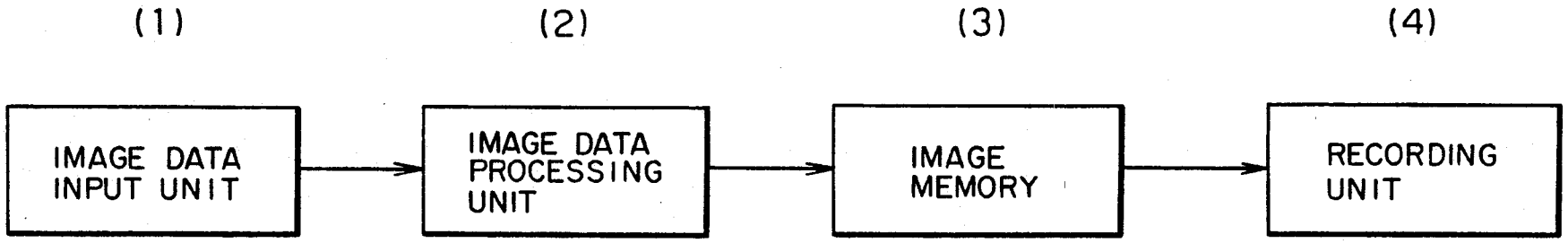
FIG. 2 is a block diagram of an image forming system.

First, forming of a multi-color image in the embodiment is made by an image forming system shown in FIG. 2. Data obtained by a color image data input unit in which a pick-up device scans an original image (FIG. 2(1)), is arithmetically computed by an image data processing unit to obtain image data (FIG. 2(2)). The image data are stored in an image memory once (FIG. 2(3)). For recording, then, the image data are read out and output to a recording unit (FIG. 2(4)), which is, for example, the color image forming apparatus shown in the embodiment of FIG. 1.

In other words, if a color signal output of an image reading apparatus which is separate from the aforesaid printer is input to the laser writing system unit 7, a laser beam generated from a semiconductor laser (not shown) in the laser writing system unit 7 is rotationally scanned by a polygonal mirror 7B revolved by a drive motor 7A. The scanned laser beam is passed through a $f\theta$ lens 7C and is bent by mirrors 7D and 7E to be projected to the outside of the photoreceptor belt 1, having been charged by the scorotron charger 6 in advance to form a bright line.

With respect to a secondary scanning, a belt index (not shown) corresponding to a specific position of the photoreceptor belt 1 is detected, or a print command signal is received, based on the detected or command signal, modulation of the semiconductor laser is started by the image signal to determine a primary scanning line. On the other hand, in the primary scanning direction, when scanning is started, the laser beam is detected by an index sensor, and the modulation of the semiconductor beam is started by the first color signal. The modulated laser beam scans on the outside of the photoreceptor belt 1.

With the primary scanning of the laser beam and the secondary scanning on the photoreceptor belt 1, a latent image corresponding to the first color is formed on the outside of the photoreceptor belt 1. The latent image is developed by the developing devices 8 having a toner of yellow (Y) contained therein to form a toner image on the photoreceptor. While the toner image obtained is held on the drum surface, it is passed under the cleaning means 13 separated from the outside of the photoreceptor belt 1 and the next copying cycle begins..

That is, the photoreceptor belt 1 is charged by the scorotron charger 6 again. The second color signal output of the image data processing unit is fed in the laser writing system unit 7. It is written on the photoreceptor surface as was the first color signal, to form a latent image. The latent image is developed by the developing device 9 having a toner of yellow (M) contained therein to form a toner image on the photoreceptor surface.

The magenta toner image is formed under existence of the yellow toner image formed already.

Similarly, a latent image formed by the third color image signal is developed by the developing device 10 containing cyan toner to form cyan toner image. A latent image formed by the fourth color image signal is developed by the developing device 11 containing black toner to form black toner image. These toner images are registered on the surface of the photoreceptor belt 1 to form a color toner images thereon.

The developing sleeves of the developing devices 8 through 11 have a D.C. and/or A.C. bias applied thereto, by which non-contact development can be made (jumping development). The photoreceptor belt 1 substrate is grounded. It should be noted that the non-contact development method can alternatively use single component developer.

Thus, the color toner image formed on the surface of the photoreceptor belt 1 is transferred by a transfer means 12 to transfer material supplied from a sheet feed cassette 14 through a sheet feed guide 15. For this, the top transfer material contained in the sheet feed cassette 14 is fed out to the transfer means 12 by rotation of a sheet feed roller 16 in synchronization with image forming on the photoreceptor belt 1 through a timing roller 17.

The transfer material having the color toner image transferred and discharged is securely separated from the photoreceptor belt 1 which abruptly changes its moving direction along the revolving roller 2 of small curvature, and is carried up. The transfer material then has the toner melted and solidified by a fixing roller 18, and is discharged out through discharge roller 19 onto a tray 20.

The photoreceptor belt 1, having completed the transference of the color toner image to the transfer material is further carried, and has the remaining toner removed by the blade 13A of the cleaning means 13 pressed and the cleaning roller 13B pressed to the photoreceptor belt 1. After cleaning, the blade 13A is separated from the photoreceptor belt 1 again, and a little later the toner cleaning roller 13B removes the toner accumulated on a tip of the blade 13A before being separated. The operation enters a new image forming process.

Figure 3A:
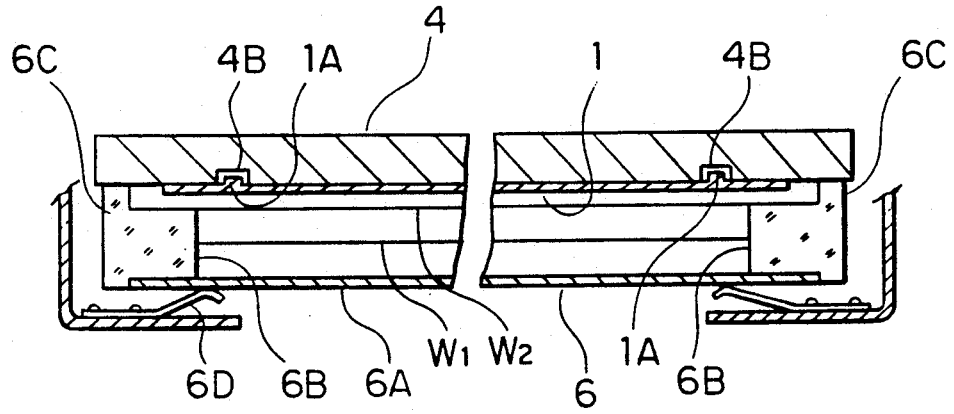
FIG. 3(A), 3(B), and 3(C) show cross sectional views of image forming apparatus in relation to the photoreceptor belt.
Figure 3B:
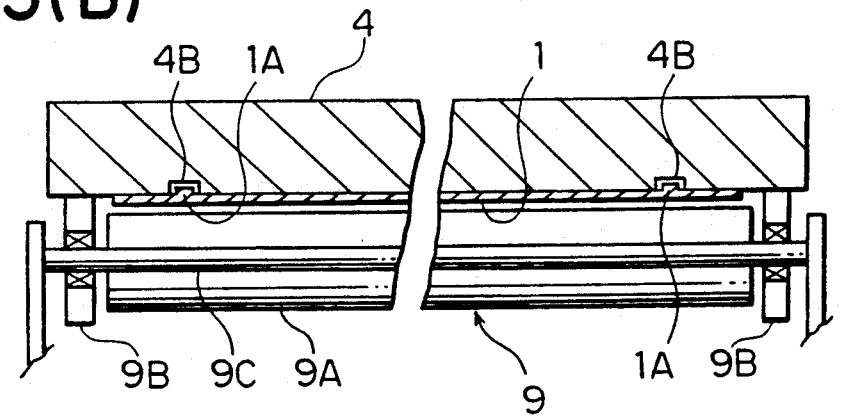
Figure 3C:
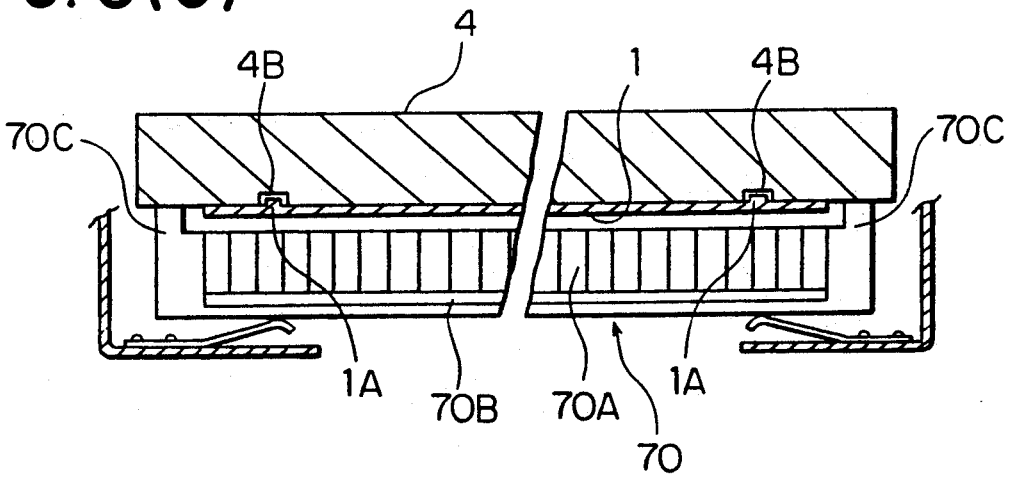

FIG. 3 shows positions of image forming means according to the present invention in relation to the photoreceptor belt 1. FIG. 3(A) is a cross-sectional view the charging means taken across A—A in FIG. 1. FIG. 3(B) is a cross-sectional view of the developing means taken across B—B in FIG. 1. FIG. 3(C) is a cross-sectional view of the image exposing means having the convergent light transmission means integrated together in place of the laser optical system.

In FIG. 3(A), the scorotron charger 6 has an electrode block 6B mounted on both ends of a back plate 6A. An electrode wire W1 and a grid W2 are provided between the electrode blocks 6B.

Each electrode block 6B has an integrally formed protrusion 6C of a predetermined height as a pressing member. The scorotron charger 6 is spring forced by an elastic member 6D such as a plate spring so that the protrusions 6C can be pressed to the guide member 4 outside the photoreceptor belt 1.

Therefore, the electrode wire W1 and the grid W2 can be always kept a predetermined distance to the outside of the photoreceptor belt 1 so that the photoreceptor can be securely charged to a predetermined potential.

In FIG. 3(B), pressing rollers 9B are rotatably supported by a rotating shaft 9C of a developing sleeve 9A of the developing device 9 as pressing members. Each of the pressing rollers 9B has an outer diameter a little greater than the developing sleeve 9A so that when it is pressed to the guide member 4, there is a gap corresponding to the development gap between the outside of the developing sleeve 9A and that of the photoreceptor belt 1.

Therefore, there is the constant development gap (0.3 to 1 mm) suitable for non-contact development between the developing sleeve 9A and the outside of the photoreceptor belt 1. This allows the developing device 9 to always make a proper developing process. For the developing devices 8, 10, and 11, similarly, the respective pressing rollers provided therein are pressed to the guide member 4 by the forcing devices mentioned above.

In FIG. 3(C), optical system 70 which is an image exposing means has a convergent light transmitting member 70A and a light emitting device 70B, such as a LED, integrated together. The light emitting device 70B has integrally a projection 70C of a predetermined height formed on both ends of the casing as stopping members.

The optical system 70 is forced with plate springs or the like so that the projections 70C can be pressed to the guide member 4 outside the photoreceptor belt 1, as with the scorotron charger 6.

Therefore, the optical system 70 also can be always kept a predetermined distance from the outside of the photoreceptor belt 1 so that the image can be accurately focused on the photoreceptor.

As described so far, the image forming means does not contact the photoreceptor belt 1 so that possible vibration due to motion of the photoreceptor belt 1 will not affect the image forming means. This means that the photoreceptor belt 1 cannot be abraded and, due to little frictional resistance, can move easily.

Such features prevent possible slippage of the photoreceptor belt 1, causing out-of-registration and distortion in the image.

The photoreceptor belt 1, as shown in FIGS. 3(A), (B), and (C), has a pair of continuous guide rails 1A formed on the inside thereof which are fitted with guide grooves 4B of the guide member 4 to prevent the photoreceptor belt 1 from snaking when in motion.

Figure 4:
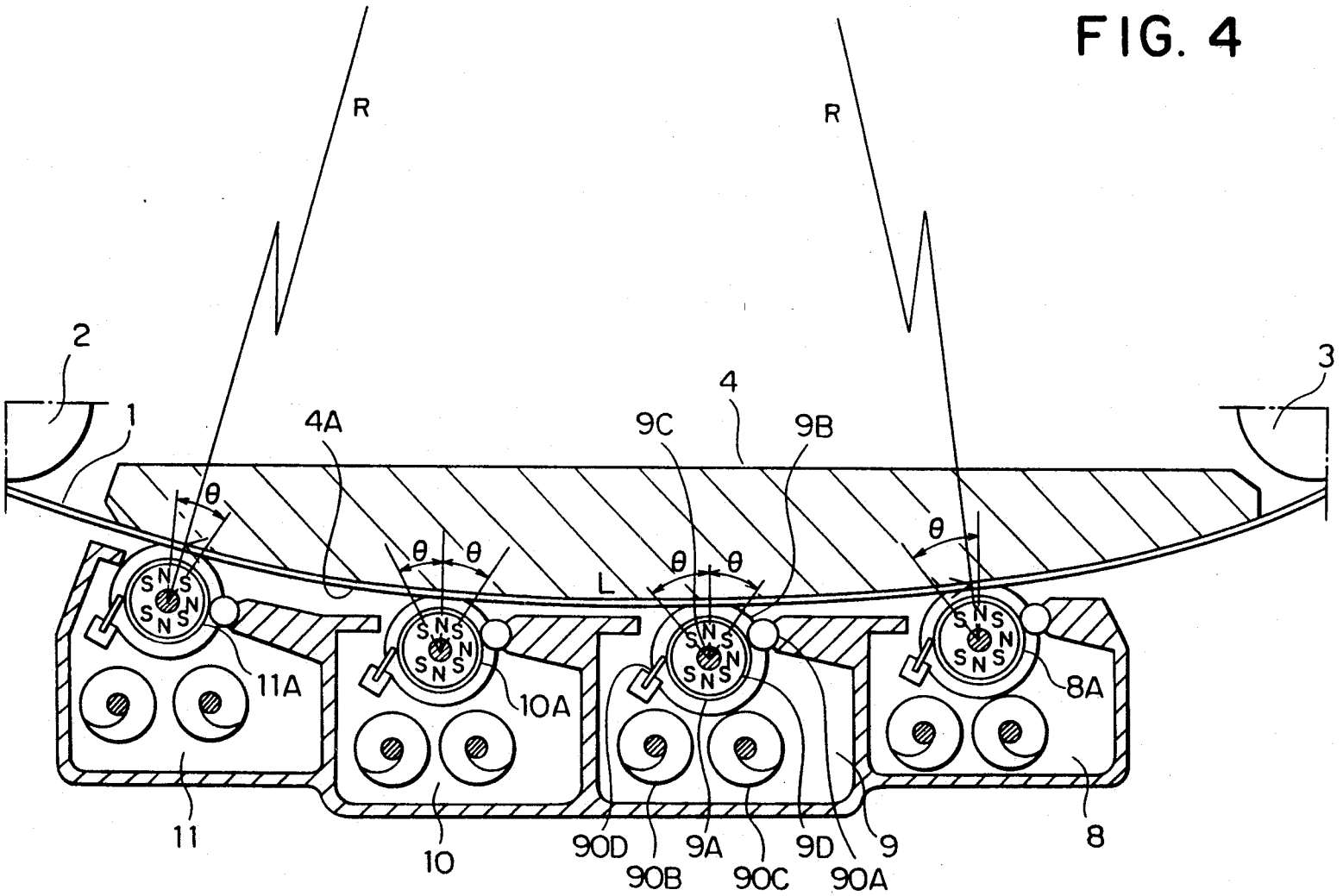
FIG. 4 is a cross sectional view of the developing means.

In turn, the following describes the structure and function of the developing devices 8, 9, 10, and 11 by reference to their cross-sectional view in FIG. 4.

As the developing devices 8, 9, 10, 11 are identical in construction and function, only the developing device 9 is described below. The developing sleeve 9A contains a fixed magnet roller 9D thereinside, and is driven photoreceptor belt 1 by the stoping roller 9B. A thin layer forming member 90A having a rigidity and magnetism is pressed to the developing sleeve 9A with a predetermined load in a state with no developer. A pair of toner feed screws 90B and 90C of screw type can carry and circulate the developer inversely to each other to fully stir and mix the toner and carrier together to feed to the developing sleeve 9A.

The magnet roller 9D comprises eight fixed magnets the N and S poles of which have equal magnetic force and are alternately arranged at equal intervals with a center angle of $45\times\pi/180$ which is an angle $\theta$ in a radian subtended by any two of the poles. However, rather than having eitht poles fixed and enclosed in the developing sleeve 9A, one pole is left out, so as to form a repulsion magnetic field thereby making removal of the developer easy. The angle $\theta$ is $45\times\pi/180$ in radian.

The magnet roller 9D used in the embodiment, as described above, comprises eight magnetic poles. Alternatively, it is generally preferable to comprise eight to sixteen magnetic poles of 300 to 900 Gauss each to keep a proper magnetic force while keeping height of magnetic brush low. The angle $\theta$, then, is (45 to 22.5)$\times\pi/180$ radian.

The toner feed screws 90B and 90C also serve as stirring members revolving opposite to each other. The toner and carrier are mixed together and moved forward by the toner feed screw 90B, and then moved backward by 90C. Thus, a uniform developer is charged with friction, and is stuck to layers on the developing sleeve 9A.

The developer layer of thin film stuck on the developing sleeve 9A inversely develop the latent image on the photoreceptor belt 1 moved clockwise in the developing region in the non-contact developing method with the above mentioned development gap, thereby forming the toner image.

In the non-contact development, a developing bias containing an A.C. component as well as a D.C. component is applied from a power source (not shown) to the developing sleeve 9A. As a result, only the toner in the developer on the developing sleeve 9A sticks on the surface of the latent image.

The developer in which the toner component has been consumed is high in the carrier ratio. It is fed by the developing sleeve 9A and is removed off and collected by the scraper 90D, and is mixed with the developer with a high toner ratio again.

On the other hand, the guide member 4 has a convex curvature 4A of equal radius of curvature R faced with the inside of the photoreceptor belt 1. The inside of the photoreceptor belt 1 is slid on the curvature 4A to properly position the photoreceptor side of the photoreceptor belt 1 during motion.

The curvature 4A, as described above, is a simple concave surface of the single radius of curvature R. It, therefore, does not give a large frictional resistance to the photoreceptor belt 1. The photoreceptor belt 1 also can be moved smoothly at a stable speed as it is pressed uniformly. Alternatively, of course, the photoreceptor belt 1 may not be in contact with all the surface of the sleeve 9A can be made more convex to reduce the friction of the photoreceptor belt 1 on the curvature 4A.

As for a condition for the radius of curvature R of the curvature 4A positioning on the inside of the photoreceptor belt 1 facing the developing sleeves 8A through 11A of the developing devices 8 through 11 arranged in series, it is preferably a length along a circumferential length of the photoreceptor belt 1 facing the developing sleeves 8A through 11 A. In other words, it is preferable that the angle $\theta$ subtended by any two of the poles of the magnet roller 9D is $$L/R < \theta \text{radian}$$

where L is a maximum length. That is, the condition is that a center angle subtended from a center of the developing sleeve 8A to that of the developing sleeve 11A, which are furthest apart, with a center of the curvature of the curvature 4A being vertex is smaller than the angle $\theta$ of the magnet roller 9D. With use of the guide member 4 having the curvature 4A of the radius of curvature R and the maximum length L which meets the above condition, the developing devices 8 through 11 cannot only be arranged in series, but also have no difference in their developing property. If the radius of curvature R is large enough, developing devices 8 through 11 can be linearly arranged in series. This allows the developing devices 8 through 11 to be manufactured together, thereby reducing manufacturing cost and making the construction very simple.

The guide member 4 also can be used as a container for collecting the waste toner collected by the cleaning means 13. In this case, the guide member 4 should be made a hollow container, an inside of which can be closed.

The radius of curvature R is preferably $$R > L/\theta = 75 \text{ cm}$$

as $\theta = (45 \text{ to } 22.5) \times \pi/180$ and L is around 30 cm in the construction of FIG. 1.

In a construction that four sets of charger, image exposure means, and developing unit are arranged in series with the belt photoreceptor, L becomes around 60 cm. The radius of curvature R, then, should be made greater than 150 cm to accomplish the series arrangement.

The flexible belt-like image carrier used in the color image forming apparatus according to the present invention can be accurately set in position and moved at a stable speed. This allows the image forming means to fully perform in a compact fashion to always reproduce quality color images. Further, as the developing means can be provided in series, their developing performance is not affected, and they can be manufactured together, thereby reducing the manufacturing cost and making the construction very simple.

What is claimed is:

1. A color image forming apparatus comprising:

(a) a belt type image carrier extending around two rollers;

(b) a guide between said two rollers on which said image carrier member is suitably conveyed, said guide having a convex curvature toward said image carrier, and (c) a plurality of developers facing said image carrier serially along a path of movement of said image carrier, each of said development provided with a magnetic roll in which a first magnetic pole facing said image carrier most adjacently and another magnetic pole next to the first magnetic pole are disposed at a predetermined angle, satisfying the following formula:

$$L/R < \theta$$

in which R is a radius of the curvature of said guide, L is a maximum length of said image carrier along its circumferential surface facing said plurality of developers and $\theta$ is said predetermined angle.

2. The apparatus of claim 1 wherein said predetermined angle is $(45 \text{ to } 22.5) \times \pi/180$ radians.

3. The apparatus of claim 1 wherein said guide is adapted for collection of waste toner removed from said image carrier.

4. The apparatus of claim 1 wherein said developers do not contact said image carrier.

* * * * *